US010407210B2

(12) United States Patent
Ferry

(10) Patent No.: US 10,407,210 B2
(45) Date of Patent: Sep. 10, 2019

(54) PLASTIC CUP WITH A THIN OUTER SLEEVE AND FOOD PRODUCT PACK COMPRISING SUCH CUPS

(71) Applicant: COMPAGNIE GERVAIS DANONE, Paris (FR)

(72) Inventor: Vincent Ferry, Paris (FR)

(73) Assignee: COMPAGNIE GERVAIS DANONE, Paris (FR)

( * ) Notice: Subject to any disclaimer, the term of this patent is extended or adjusted under 35 U.S.C. 154(b) by 0 days.

(21) Appl. No.: 15/548,709

(22) PCT Filed: Feb. 3, 2015

(86) PCT No.: PCT/IB2015/000266
§ 371 (c)(1),
(2) Date: Aug. 3, 2017

(87) PCT Pub. No.: WO2016/124958
PCT Pub. Date: Aug. 11, 2016

(65) Prior Publication Data

US 2018/0016061 A1 Jan. 18, 2018

(51) Int. Cl.
*B65D 21/02* (2006.01)
*B65D 25/36* (2006.01)
(Continued)

(52) U.S. Cl.
CPC ..... *B65D 21/0206* (2013.01); *B65B 9/20* (2013.01); *B65D 1/26* (2013.01); *B65D 1/30* (2013.01);
(Continued)

(58) Field of Classification Search
CPC .... B65D 21/0206; B65D 1/0223; B65D 1/16; B65B 9/20; B31B 2110/10
See application file for complete search history.

(56) References Cited

U.S. PATENT DOCUMENTS 3,194,423 A 7/1965 Mailoff
3,680,763 A 8/1972 Ludder
(Continued)

FOREIGN PATENT DOCUMENTS

DE 9314242 11/1993
WO 2014006033 A1 1/2014

OTHER PUBLICATIONS

International Search Report, dated Oct. 13, 2015, from corresponding PCT application No. PCT/IB2015/000266.
(Continued)

*Primary Examiner* — Shawn M Braden
(74) *Attorney, Agent, or Firm* — Young & Thompson

(57) ABSTRACT

The FFS plastic container for a dairy product or similar food composition is provided with a body having a side wall extending along a longitudinal axis from a bottom to a top that defines a wide upper opening. The container, which is provided with a generally planar annular flange integral with the body and extending around the upper opening, has a decorative layer around the side wall. The upper portion of the side wall tapers toward the opening. Either a peripheral bulge is formed in the side wall at a junction between the upper portion and a lower portion, or the lower portion has a generally cylindrical shape. The decorative layer is defined by a plastic sleeve that includes a shrink film annularly secured to the upper portion, the sleeve extending adjacent or over the junction.

21 Claims, 5 Drawing Sheets

(51) Int. Cl.

| | |
|---|---|
| ***B65D 1/26*** | (2006.01) |
| ***B65D 1/30*** | (2006.01) |
| ***B65B 9/20*** | (2012.01) |
| ***B65D 75/00*** | (2006.01) |
| ***B65D 77/20*** | (2006.01) |
| ***B65D 77/38*** | (2006.01) |
| ***B65D 85/72*** | (2006.01) |

(52) U.S. Cl.
CPC ..... *B65D 25/36* (2013.01); *B65D 75/002* (2013.01); *B65D 77/20* (2013.01); *B65D 77/38* (2013.01); *B65D 85/72* (2013.01)

(56) References Cited

U.S. PATENT DOCUMENTS

| | | | | |
|---|---|---|---|---|
| 5,013,517 | A | 5/1991 | Robbins, III | |
| 5,782,376 | A | 7/1998 | Brauner et al. | |
| 6,896,147 | B2 * | 5/2005 | Trude | B65D 1/0276 206/509 |
| 8,061,541 | B2 * | 11/2011 | Trumpp | B29C 49/04 215/13.1 |
| 2002/0119223 | A1 | 8/2002 | Buisson et al. | |
| 2011/0081459 | A1 * | 4/2011 | Bourguignon | B65D 1/30 426/108 |
| 2012/0251679 | A1 | 10/2012 | Ferry | |
| 2012/0318801 | A1 * | 12/2012 | Wolters | B65D 77/2032 220/359.2 |
| 2015/0121806 | A1 | 5/2015 | Koolhaas | |

OTHER PUBLICATIONS

Chinese Office Action for Application No. 201580076116.6 dated Apr. 16, 2019 with English translation provided.

* cited by examiner

PLASTIC CUP WITH A THIN OUTER SLEEVE AND FOOD PRODUCT PACK COMPRISING SUCH CUPS

FIELD OF THE INVENTION

The present invention generally relates to containers used in food packaging industry, particularly to plastic flanged cups covered by a decorative band, such as yoghurt cups or similar. The invention also concerns a pack comprising such flanged containers and a method of producing the containers.

More particularly, the invention relates to a container for a food composition, in particular a dairy product composition, comprising:

- a plastic body comprising a bottom, for example a planar bottom, and a side wall extending along a longitudinal axis from said bottom to a top that defines an upper opening (wide opening allowing retrieval of a food content by a conventional spoon or similar utensil), the body being hollow,
- a decorative band extending around the side wall, and
- a generally planar annular flange integral with the body and connected to the top of the body, the flange extending around the upper opening.

BACKGROUND OF THE INVENTION

Flanged containers are produced in very large quantities. The cup that includes the body and all or part of the upper face of the container is generally produced by thermoforming from a plastic sheet in a mold. The containers are formed simultaneously and their outer rims (at the flange) remain joined together. Such method makes it possible to produce particularly inexpensive packaging containers, while at the same time adhering to the hygiene standards necessary for food products.

Decorative bands are used to modify the appearance of a container and/or to provide an information support.

Decorative bands for thermoformed containers have hitherto had an elongate rectangular shape. They are generally cut out from a strip of thin material, such as paper, which is printed and stored in the form of a roll, before the bands are cut out. Flanged containers provided with a decorative band that may cover all or part of a side wall that tapers downwardly are commercially available. The band is applied by introduction in a mold of a material of thermofoil that will adhere to the outer face of the side wall upon thermoforming.

Flanged containers may be arranged in a pack. Regarding the thermoforming to form the volume, the plastic sheet is heated and then drawn into a cavity by vacuum and/or pressure. As the sheet is drawn into the cavity, the thickness of the portion of the sheet drawn into the cavity is reduced as the sheet material is stretched into the cavity. With such a method, the side wall of the body is thin, while the flange has the same thickness and the same rigidity as the original sheet of plastic. As the flange is thin and planar, the body essentially defines the height of the container. The unit cost of each packaging can be decreased by producing such flanged containers of relatively low thickness, but without impairing its strength and its aesthetic characteristics.

Besides, in food industry, the plastic containers can be stacked on top of one another so as to form stacks which can be layered on a pallet. A loading weight on a pallet may be much more than 500 kg. Such stacks allow the packaging items to withstand the compressive load of the packaging items on top. Accordingly, it is not easy to reduce the thickness of the different components of the containers and thus there is a need for solutions allowing plastic material to be saved.

The technology FFS (Form, Fill and Seal) is typically used to produce at high rate conventional containers grouped in packs and each sealed conventionally by a flexible closure lid (membrane). The machines using FFS technology are known as reliable to produce packs of flanged containers at high rate. It also allows fixing of paper-based decorative bands for improved appearance of the containers. It is understood that saving plastic material and need for improving the aesthetical aspect of the containers are contradictory requirements.

When securing a decorative band around the side wall of containers, an accurate positioning of the decorative band has to be performed. Especially, the decorative band should ideally:

- be located a the same height level because a difference of level inside a same pack of containers would be perceived as a defect by a consumer,
- extend around the side wall by defining a constant thickness, preferably without any overlap.

Accordingly, there is an interest for producing food products having very good appearances and well adapted to be produced by the most efficient industrial processes, for example adapted to multipack and/or FFS productions.

Document WO 2014/006033 A1 discloses a container tapering downwardly sleeving method, having appropriate processing speed and suitable to define a rectangular decorative band. The sleeve is made of a heat shrinkable film. Labelling operations are carried out using processes that require the formation of a tube or sleeve of the heat shrink film that is placed over the container and heated in order to shrink the film to conform to the size and shape of the container. For accuracy of the positioning, a plate or a belt is used to define a sleeve support until shrinkage of the film occurs. Such sleeving method prevents inverting the containers or similar complicated operation when a band shaped label has to be unrolled and cut. This document discloses that partial sleeves can be used. But in such case there is need of free volume around the cups (in order to bear the sleeves and prevent any fall before the heating).

Besides, consumers are attracted by the appearance of containers having enlarged cross sections in a part distant from the wide opening, optionally presenting a bulge. On another hand consumers are also used to having containers with a decorative banderole. There is a need for means to vary the visual appearance of containers having sidewalls with such enlarged cross sections, optionally presenting a bulge, and/or for providing containers having a decorative banderole and sidewalls tapering upwardly, preferably with a good productivity.

More generally, there is a need to provide containers that can be produced at high rate (typically flanged containers that can be optionally sold in packs), while having very good appearances and optimizing the amount of plastic to be used.

SUMMARY OF THE INVENTION

The purpose of the present invention is to provide containers addressing one or more of the above mentioned problems.

To this end, embodiments of the present invention provide a container for a food composition, in particular a dairy product composition, comprising:

a plastic hollow body comprising a bottom and a side wall extending along a longitudinal axis from the bottom to a top that defines an upper opening, a generally planar annular flange integral with the body and connected to the top of the body, the flange extending around the upper opening and having a maximal radial extension superior or equal to 3 mm, preferably superior or equal to 5 mm, and a decorative layer extending around the side wall, the side wall comprising an upper portion that comprises the top of the body and having a height h2, an optional lower portion (of course distinct from the upper portion) having a height h1 that is preferably inferior to the height h2, wherein the upper portion tapers toward the upper opening.

Additionally, the decorative layer is defined by a plastic sleeve that includes a (heat-sensitive) shrink film annularly secured to the upper portion.

According to a particular feature, the side wall is provided with the lower portion and either comprises a peripheral bulge at a junction between the upper portion and the lower portion, or the lower portion has a generally cylindrical shape, the plastic sleeve being in contact with the upper portion at least in an annular area adjacent to the junction.

With such plastic sleeved and flanged container having a maximum of width at or near the lower portion, the bulk of the container is not perceived as thin as conventional plastic sleeved and flanged container, especially when the opening is not wider than 60 or 70 mm. For dairy containers such as yogurt cups, an opening often has a maximal diameter strictly lower than 60 mm and higher than 40 or 45 mm.

Because of the locally greater cross section (at the bulge or junction between the lower portion and upper portion), the sleeve is firstly in contact with the side wall at a great distance from the flange. Such contact at early stage during the shrinking of the sleeve (typically at a location near the sleeve support) is of interest to guide the biaxial shrinking of the film, with a geometry of the surface that is suitable for preventing downward sliding due to gravity effect. Accurate positioning can thus be obtained and the sleeve is efficiently secured to the upper portion. As compared to flanged containers of conical shape with a side wall tapering downwardly, it is understood that the container provided with an annular bulge or similar profile with an upper portion tapering upwardly better prevents downward sliding of the sleeve.

Use of a partial sleeve, extending essentially above the lower portion, can also be of interest with such flanged container because the content displayed by the sleeve is provided in a surface enlarged with increasing spacing from the flange. A sleeve covering both the lower portion and the upper portion is also good perceived, especially when the height of the sleeve is the same or close to the height of the upper portion.

In various embodiments of the flanged container of the invention, recourse may optionally also be had to one or more of the following dispositions:

the upper opening is circular and the bottom has a circular outer edge (with the circular cross section at the bottom, risk of downward displacement is usually increased but this is not the case when using the overlapping of the bulged side wall and the heat shrink sleeve). It is also considered that a circular cross section is of interest for the saving of plastic as the body better react to a vertical compressive load.

Dint is a diameter of the upper opening and the circular outer edge of the bottom defines a diameter D2, which is inferior or equal to the diameter Dint. At least one of the following relations is satisfied, Dint≤3/2*D2 and 3/4*D2≤Dint.

the following relation is satisfied: Dint<1.25*D2. Preferably, D2<Dint. Small decrease of the size of the bottom is useful to in fine reduce plastic material, as the thickness in the bottom can be typically higher than in the side wall, in order to withstand loads during transport.

the plastic sleeve is a single piece having an upper edge adjacent to the flange and a lower edge extending around at least one of the lower portion and the peripheral bulge, the height h2 of the upper portion and a minimum height h5 of the plastic sleeve, which is defined between the upper edge and the lower edge, being both greater than the height h1 of the lower portion. Accordingly, the surface defined by the upper portion, available for efficient display by the sleeve, is relatively large. Such surface is of sufficient height and increase in cross section can be progressive.

the plastic sleeve comprises an upper annular end defining a first perimeter SP1 and a lower annular end defining a second perimeter SP2, the plastic sleeve tapering from the lower annular end to the upper annular end, each of the first perimeter and second perimeter being measured in a respective virtual plane perpendicular relative to the longitudinal axis, the ratio SP2:SP1 being superior to 1:0.84 and lower than 1:0.98. With such perimeters reflecting changes in the cross sections of the covered part of the side wall, gripping of the container at the covered part is optimally improved (with a reduction of cross section near the flange, which is particularly ergonomic) for persons having small hands such as children, without significantly deforming the optional printed marks or similar information displayed by the outer face of the sleeve.

the sleeve has a height h5 and is a partial sleeve for the side wall, so that at least one part of the lower portion is not covered by the sleeve, the ratio h2:h5 being between 1.3:1 and 1:0.7. Alternatively, a lower part of the upper portion is not covered by the sleeve, the ratio h2:h5 being between 1.3:1 and 1:0.7. With such arrangement, sleeve shrink material can be saved. It is also advantageous having an additional layer having a reinforcing effect only at a distance from the bottom. Indeed, the reinforcing effect may be useful to locally reduce thickness of the upper portion. Strength requirements at the lower portion cause the thickness of thermoformed body material to be higher. Indeed, ruptures are more frequently observed in the lower portion, especially when the lower portion has a circular cross section and is tapering downwardly. As it is more difficult to strengthen the lower portion of a thin side wall by use of a decorative layer, it can be advantageous to provide a thickness profile with an increase of thickness toward the bottom. The thickness in the tapering part of the upper portion may be decreased by at least 0.03-0.05 mm as compared to a minimum thickness in the lower portion of the side wall.

the side wall comprises a single annular bulge having a circular cross section and the upper portion has a maximal width, defined at the bulge, which is greater than the height of the upper portion, the upper opening having a diameter that is superior to 40 mm. With such configuration, the container may have a compact shape with optimized height. This is of interest for yogurt containers that have to be typically arranged at a shelves location of low height.

the body and the flange are made of a same thermoformed plastic, preferably PET.

the shrink film of the plastic sleeve, preferably of a thickness lower than 100 μm, is at least partly transparent or translucent.

the body is at least partly transparent or translucent. With such configuration, consumers may perceive the content, especially when the sleeve is also transparent or translucent or when the sleeve if of lower height as compared to the height of the side wall.

the upper portion of the side wall has cross sections of an increasing size with increased spacing from the flange, optionally except in an annular upper end of the upper portion. Preferably, the annular upper end is of cylindrical shape and has a height lower than 5 or 6 mm; such annular end may be at least partly not covered by the sleeve.

the height h2 of the upper portion is higher than 30 mm and lower than 65 mm, the increase in size of the cross sections of the upper portion being higher at a range of longitudinal distance [5-25 mm] from the flange as compared to the increase in size of the cross sections of the upper portion near the lower portion. With such profile of the upper portion, the junction with the lower portion can be defined by a tangential connection.

the maximal radial extension of the flange is higher than 5 mm, preferably higher than 7 mm, and lower than 16 mm, preferably lower or equal to 12 mm, the flange comprising a protruding portion provided with a determined outer straight side edge, and at least one convex flange portion connected to the protruding portion.

the protruding portion radially protrudes outward more, with respect to the side wall, than the convex flange portion, whereby the protruding portion defines the maximal radial extension. With such configuration of the flange, the container can be attached to another similar container at the protruding portion of the flange, optionally with a pre-cut line. As the junction between two adjacent containers can thus be significantly radially shifted with respect to the side wall, the bulges are not interfering and use of multi cavities mold is advantageously available.

the bulge does not protrude too far so that the following relation is satisfied:

$$Dm<Em+Rint$$

where Dm is a maximal radial distance between the side wall and the longitudinal axis, Em is the maximal radial extension of the flange, and Rint is a radial distance between the longitudinal axis and an inner edge of the flange (measured at a same angular position as the maximal radial extension Em).

the convex flange portion, which is preferably continuously rounded, has a C-shaped outer edge. With such cut of the flange, one or two convex flange portions may be used to allow accurate fixing of a sealing membrane, but with a reduced radial extension so that plastic material is saved.

when there is only one convex flange portion (single continuous portion having two ends each connected to the protruding portion), the maximal radial extension of the flange can be at least twice a maximal radial extension in the convex flange portion.

the side wall has an outer diameter or maximum radial dimension D3 at the junction between the lower portion and the upper portion, the flange having a constant outer diameter D1 in said convex flange portion and a constant inner diameter Dint for circularly delimiting the upper opening, and wherein the following relation is satisfied: Dint<D3<D1, while D1 is lower than 7/5*Dint, preferably lower than 1.25*Dint. With such geometry, the periphery of the bulged junction and the periphery of the flange are optimally protruding outside a virtual cylinder extending longitudinally downwards from the upper opening and having same cross section as the upper opening. As a result, a good compromise is obtained between the capacity of the container and ease of retrieving the food composition for the final consumer.

a sealing membrane is fixed only to an upper face of the flange, the sealing membrane sealing the upper opening and preferably defining an uncovered top surface of the container.

the sealing membrane covers entirely the upper face of the flange.

the determined outer straight side edge of the protruding portion has a length L1 superior to 12 mm and inferior to 30 mm, the flange being inscribed in a virtual rectangle, the determined outer straight edge being in alignment with one side of the virtual rectangle having a length L2, the following relation being satisfied: 1/5<L1/L2<2/5. Such shape of the protruding portion is of interest to facilitate breakage of a junction in a pack of containers and minimize plastic material used in the flange.

the sealing membrane comprises a closing portion sealing the upper opening in an annular area, the closing portion having a circular circumference defined by an outer edge of said annular area, and a tab portion entirely offset relative to said annular area, covering the protruding portion without being sealed on the protruding portion, the closing portion and the tab portion being parts of a single piece foil.

the protruding portion comprises an intermediate portion provided with a convex rounded outer edge, the maximal radial extension of the flange being defined in the intermediate portion of the protruding portion, the convex rounded outer edge connecting the determined outer straight side edge to an adjacent outer straight side edge, an angle superior to 100°, and preferably comprised between 110° and 135°, being measured between the determined outer straight side edge and the adjacent outer straight side edge. With such cut, when the consumer wishes to remove the sealing membrane, he can touch the protruding portion without any risk of contact with a sharp angle.

the upper portion and the lower portion intersecting and interconnecting at a peripheral intersection line, the lower portion tapering from the upper portion toward the bottom in a curved manner.

the outer perimeter SP2 defined at the peripheral intersection line and the outer perimeter T1 defined by the flange are such that the following relation is satisfied: 0.8<T1/SP2<1.1.

A further purpose of the invention is to provide a food pack easy to be manipulated in a supermarket (before exposure of the containers by the operators and thereafter by the final consumer) and resistant while reducing amount of plastic material.

To this end, embodiments of the present invention provide, in a food pack, a plurality of containers according to the invention arranged in at least one row, the flanges of the pack being integrally formed and separably joined to each other at a breakable junction between two flanges of two distinct containers of the pack.

Accordingly, there is provided a pack produced at a reduced cost, which is favourably perceived by the consumer.

According to a particular feature, the flanges have a constant thickness, which is also provided at the breakable junction.

The pack has a front side and a rear side, the breakable junction being offset toward one of the front side and the rear side, a sharp angle inferior to 90°, preferably inferior to 70°, being defined by a V-cut adjacent to an end of the breakable junction at the other one of the front side and the rear side. With such configuration with a sharp cut (V-cut), breakage of the junction is obtained with minimum of effort.

The invention also concerns the product comprising the container of the invention and the food composition in the container. The food composition can be any edible composition. The food composition can be a liquid, viscous semi-fluid, or solid composition. The food composition is preferably a dairy composition, preferably a fermented dairy composition, for example a yogurt-based composition.

It is also provided, according to the invention, a process of making a container according to the invention for a food composition, using a plastic sheet, the container having an upper opening and a cavity defined by a plastic body, the process comprising:

- forming the cavity after heating the plastic sheet, the body that defines the cavity having a side wall provided with a lower portion and an upper portion that tapers toward the upper opening;
- filing the cavity through the upper opening with a predetermined dose of the food composition;
- sealing the cavity by use of a sealing membrane;
- cutting the plastic sheet to define a generally planar annular flange integral with the body, which extends around the upper opening and has a maximal radial extension superior or equal to 3 mm, preferably superior or equal to 5 mm, the flange being covered by the sealing membrane;
- supplying a sleeve of heat shrinkable film near the lower portion and arranging the sleeve around the side wall of the body and entirely below the flange;
- annularly securing the sleeve to the upper portion, by heating the heat shrinkable film so that the sleeve is securely in contact with the upper portion at least in an annular area adjacent to a junction with the lower portion.

According to a particularity, the cavity is formed in a mold having a plurality of identical mold cavities. The body is released from the corresponding mold cavity by moving a part of the mold which partly surrounds the corresponding mold cavity.

Other features and advantages of the invention will become apparent to those skilled in the art during the description which will follow, given by way of a non-limiting example, with reference to the appended drawings.

DETAILED DESCRIPTION OF EMBODIMENTS

In the various figures, the same references are used to designate identical or similar elements.

Figure 1:
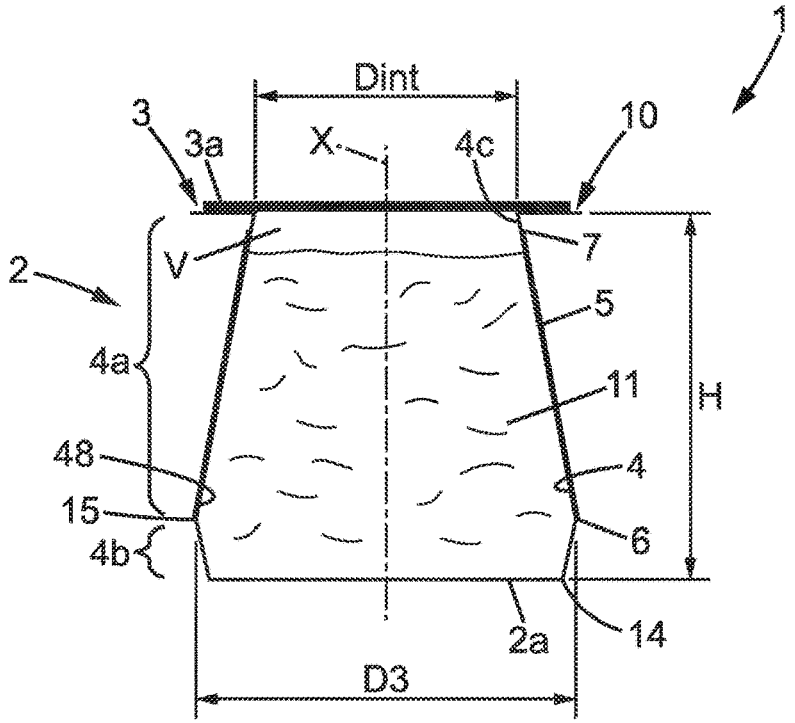
FIG. 1 is a longitudinal section view of a container according to an embodiment of the invention.

Referring to FIG. 1, a container 1 that comprises a hollow body 2 and a sealing system 3 is shown. The body 2 comprises a bottom 2*a* and a side wall 4 extending along a longitudinal axis X from the bottom 2*a* to a top 4*c*. The bottom 2*a* is generally planar or has as shape adapted for maintaining the container 1 in a more or less vertical position when standing on a horizontal support. The side wall 4 comprises an upper portion 4*a* and a lower portion 4*b*. Here in a preferred option, this lower portion 4*a* slightly tapers toward the bottom 2*a*. The height h1 of the lower portion 4*b* is less than half of the height H of the container 1, preferably equal or less than a third of the height H. With such an arrangement, the upper portion 4*a* may be covered by a plastic sleeve 5 of continuous annular shape. Typically, the plastic sleeve 5 may be used as a label for displaying information and/or decorating the container 1. The plastic sleeve 5 defines an outer layer (i.e. an outermost layer here in FIG. 1) of the container 1 and extends between a lower edge 6 and a typically rectilinear upper edge 7 adjacent to the single flange 10 of the body 2. Of course in variants, the upper edge 7 may be undulated or provided with incisions.

It can be seen that the body 2 has a flanged cup-like shape and is obtained by forming of a thin plastic sheet that defines the thickness of the flange 10. It can thus be seen the flange 10 (which has not been stretched) is planar and has a constant thickness E10, which is higher than the thickness of the upper portion 4*a* at least in the area covered by the plastic sleeve 5 and preferably higher than the thickness of the lower portion 4*b*. Of course, the height H is defined between a lower face of the bottom 2*a* and the flange 10.

Figure 3:
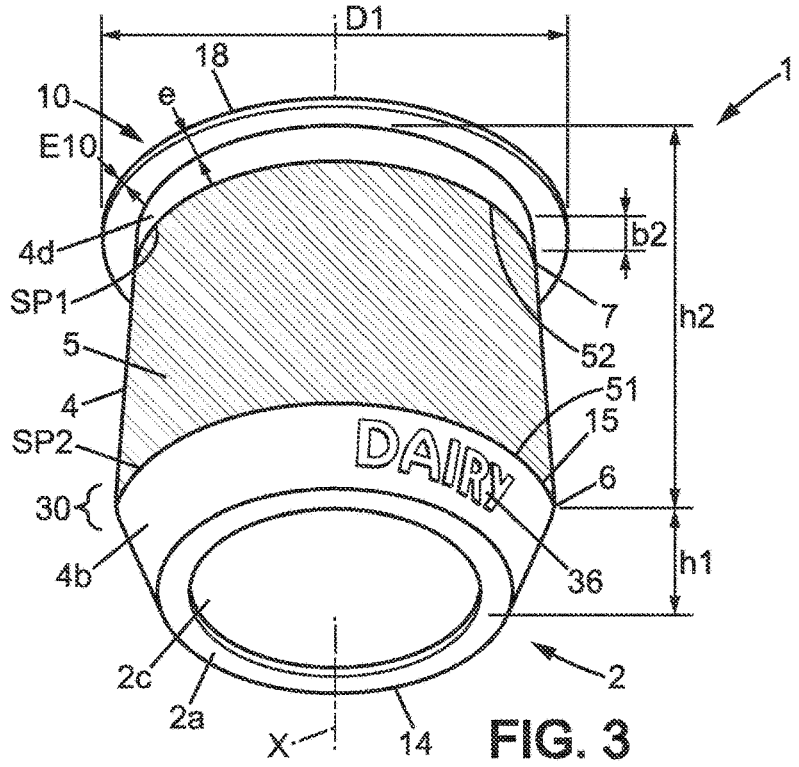
FIG. 3 is a perspective view of the container of FIG. 2.
Figure 4:
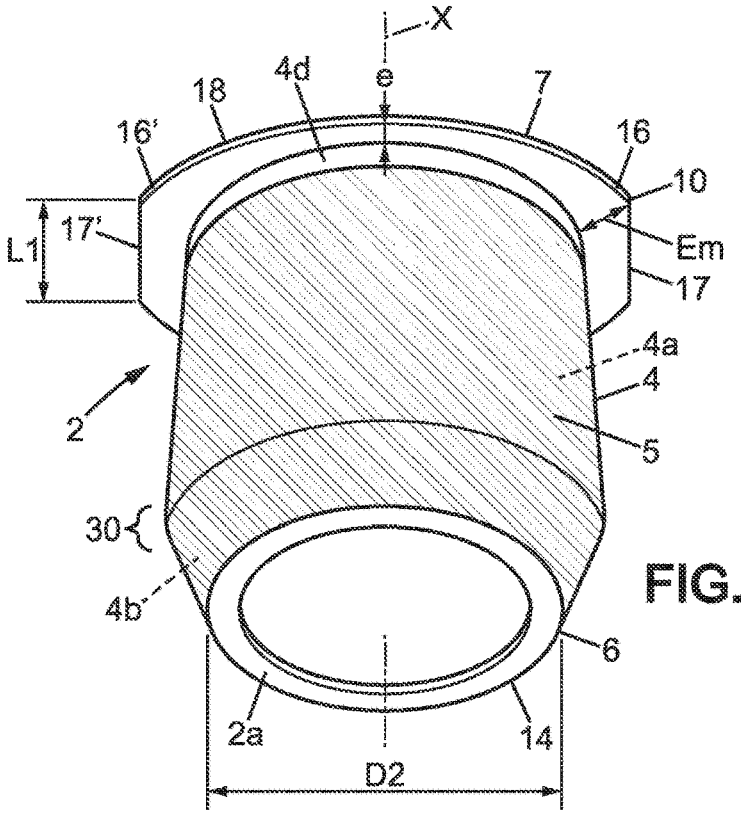
FIG. 4 is a perspective view of a container according to another embodiment of the invention.

Referring to FIGS. 3-4, the bottom 2*a* may be optionally provided with a recess or cavity 2*c* with a concavity oriented to the exterior. The annular portion of the bottom 2*a*, defined around the cavity 2*c*, has an outer diameter D2 inferior to the diameter $D_{int}$ of the upper opening 12 defined at the top 4*c* of the body 2. The bottom 2*a* provided with the cavity 2*c* has a better strength for better supporting a compression load. Of course, the bottom 2*a* may still be considered as a generally planar bottom 2, at least because the bottom 2*a* has a flat shape and the container 1 is adapted to be maintained vertically when the bottom 2*a* is in contact with a horizontal base support (the longitudinal axis X being vertical). The height of the cavity 2*c* is preferably very small, for instance about 0.5-1.5 mm.

The interior volume V of the body 2 is here filled with a dose of a food composition 11, for instance a dairy food composition. It is understood that the interior volume V may contain more than one edible component, possibly with a separation or mixing between solid content and liquid or semi liquid composition. The upper opening 12 here defines the single opening to retrieve the food composition 11. The interior volume V is here defined by a single compartment. Alternatively, a partitioning wall or embedded lid extending below the flange 10 can be added to define at least two compartments.

Figure 5:
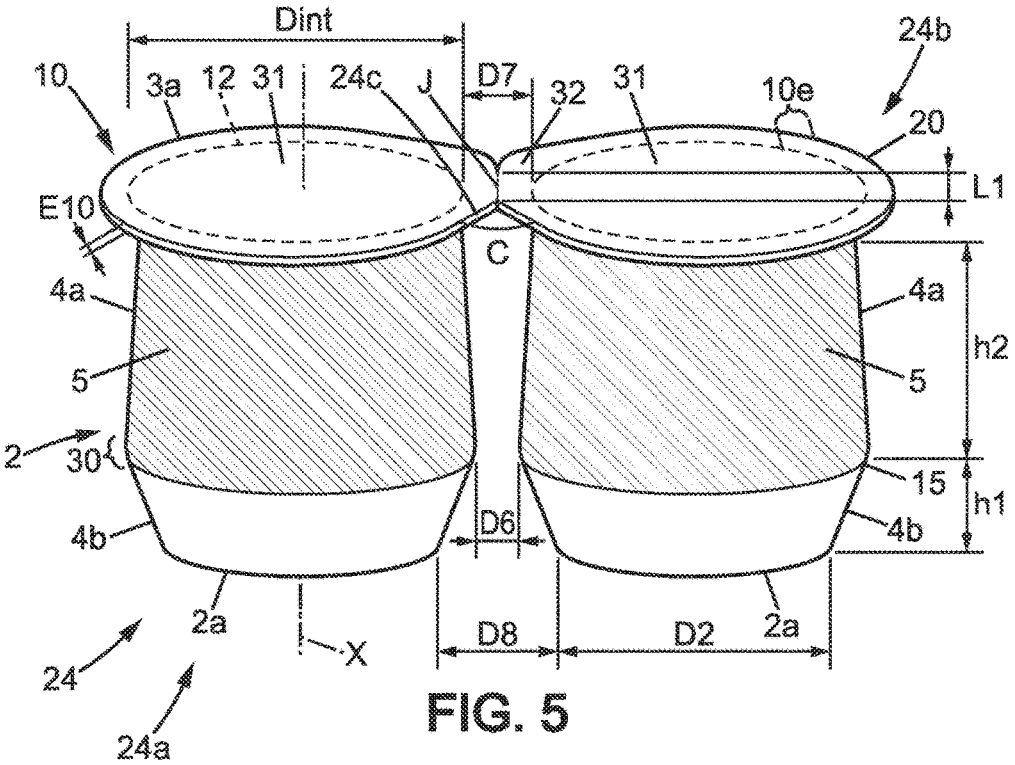
FIG. 5 is a perspective view of a pack of containers according to a preferred embodiment of the invention.

The cross sections of the body 2 can be circular, oval or substantially squared with curved corners. Preferably, the outer shape of the flange 10 is different from the cross section of the side wall 4 because the flange 10 is provided with at least one protruding portion 16 that protrudes radially outwards. Such protruding portion 16 is typically located adjacent a breakable junction J in a pack 24 of containers 1, as shown in FIG. 5 in particular. The flange 10, which extends annularly around the upper opening 12 of the body 2, has a maximal radial extension Em superior or equal to 5 mm. Here, the upper opening 12 is preferably circular or oval.

Figure 9:
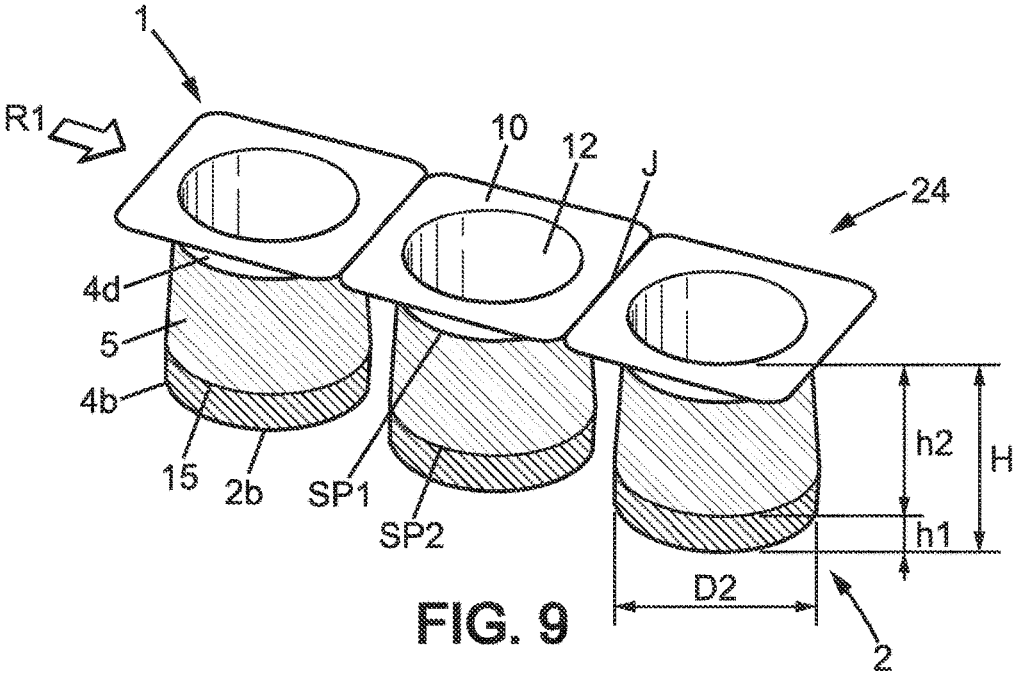
FIG. 9 is a perspective view of a pack of containers according to another embodiment of the invention.

Referring to FIGS. 5 and 9, a food pack 24 comprises for instance two, three or four individual containers 1. Of course the number of containers 1 may vary and a number of 6, 8, 10 or 12 containers 1 may be provided, in a non-limitative example. The containers 1 are arranged in at least one row, and preferably at least in two rows R1, R2 when the pack 24 comprises four or more containers 1. Each pack 24 is here provided with breakable junctions J to allow containers 1 of a same row R1 to be separated, but other junctions J or a fastening device surrounding the bodies 2 (below the flanges 10) may be used to increase the number of containers 1 in a pack 24.

It can be seen that the outer diameter D2 may be lower than 1.1*Dint to reduce the perimeter of the bearing surface of each of the containers 1. Preferably, the outer diameter D2 is lower than Dint or lower than 0.95*Dint. Here, the outer diameter D2 is also lower than 0.9*D3 but higher than 0.7*D3.

Referring to FIGS. 1-6, the longitudinal axis X is here a central symmetry axis for the side wall 4 when the side wall 4 has a circular or oval cross section (or similar cross section without small recess and adapted for use of a spoon and full retrieval of a semi-liquid food composition 11 or composition having a firm texture). The side wall 4 has an enlarged part at an intermediate level between the bottom 2*a* and the flange 10. Here, the lower end of the side wall 4 is typically not tapering like the upper portion 4*a*. Indeed:

- either the lower portion 4*b* is tapering downwardly and an annular bulge 30 is thus formed at the junction 15 between the upper portion 4*a* and the lower portion 4*b* or in an annular area adjacent to this junction 15,
- or the lower portion 4*b* has a substantially constant cross section (see for instance FIG. 9).

The term "bulge" is here used in a non-restricted manned. The bulge 30 can be defined in an annular area adjacent to a bearing plane defined by the bottom 2. When a plastic sleeve 5 defining a decorative layer is provided around the side wall 4, such sleeve 5 is of annular shape and covers the enlarged part. The outer decorative layer is here defined by a sleeve 5 that extends upwardly to an upper annular end 52 typically provided with the upper edge 7 parallel to the flange 10. Here the lower edge 6 is defined by a lower annular end 51 of the sleeve 5, which extends around at least one of the lower portion 4*b* and the peripheral bulge 30.

The lower portion 32 is here either continuously rounded from the bottom 2*a* as far as the peripheral intersection line that forms the junction 15 (see FIG. 4), or is regularly tapered (see FIGS. 1-2), or defines a cylindrical part (see FIG. 9). Of course the shape of the lower portion 4*b* illustrated in one embodiment can also be used in another embodiment. In some less preferred variants, the lower portion 4*b* can be provided with a pattern, for instance with alternation of hollows and small protrusions, in order to increase rigidity near the bottom 2*a*.

The height h2 of the upper portion 4*a* can be more than half of the height H of the container 1, so that a wide surface 35 (see FIG. 6) is available above the junction 15 for the sleeve 5. The minimum height h5 of the sleeve 5, which is defined between the lower edge 6 and the upper edge 7, is here greater than the height h1 of the lower portion 4*b*. In FIGS. 1 and 3, such height h5 is not superior to the height h2. The lower edge 6 may extend parallel to the flange 10, without extending below the bulge 30. Alternatively as shown in FIG. 4, the height h5 may be close to the height H of the container 1, in order to cover at least partly the lower portion 4*b*. Optionally, the sleeve 5 is folded at a folded line corresponding to the lower end of the side wall 4. In such option, the bottom 2*a* is covered, possibly entirely, by a folded part of the sleeve 5.

When the sleeve 5 only covers the upper portion 4*a*, such partial sleeve may have a height h5 inferior (from max. 30%), equal or not exceeding from more than 10-15% the inner diameter $D_{int}$ of the upper opening 12. With such an arrangement, the upper portion 4*a* is particularly useful for displaying information and is typically covered by a trapezoidal shaped shrink sleeve 5 arranged in a form of a label. Such trapezoidal shape (as perceived by the consumer) remains close from the rectangular shape.

Referring to FIG. 3 when the lower portion 4*b* is not covered by the sleeve 5 and to FIG. 9 when the lower portion 4*b* is not significantly tapering toward the bottom 2*a*, it can be seen that a first perimeter SP1 defined by the upper annular end 52 is inferior to a second perimeter SP2 defined by the lower annular end 51. Of course, such configuration is obtained when the upper portion 4*a* of the side wall 4 has cross sections of an increasing size with increased spacing from the flange 10, except in an optional annular upper end 4*d* of the upper portion 4*a*. Such annular upper end 4*d* may have a cylindrical shape, preferably without any relief (i.e. with a smooth surface that cannot form retaining means for a sleeve 5). The optional uncovered annular upper end 4*d* preferably defines a constant small gap between the flange 10 and the upper rectilinear edge 7 of the sleeve 5 (being understood that the edge 7 is also rectilinear before fixation onto the upper receiving area of the upper portion 4*a*). Here the distance b2 from the flange 10 may be about 1-5 mm only, preferably 1-3 mm.

The container 1 shown on FIG. 3 is provided with a brand name or a similar pattern 36, which can be marked in the lower portion 4*b* when forming the body 2. With the lower portion 4*b* tapered toward the bottom 2*a*, the height h2 of the upper portion 4*a* defining an upper area for the sleeve 5 is advantageously reduced, thus saving packaging material. The height h2 of the upper portion 4*a* is for instance higher than 30 mm and lower than 65 mm.

Figure 6:
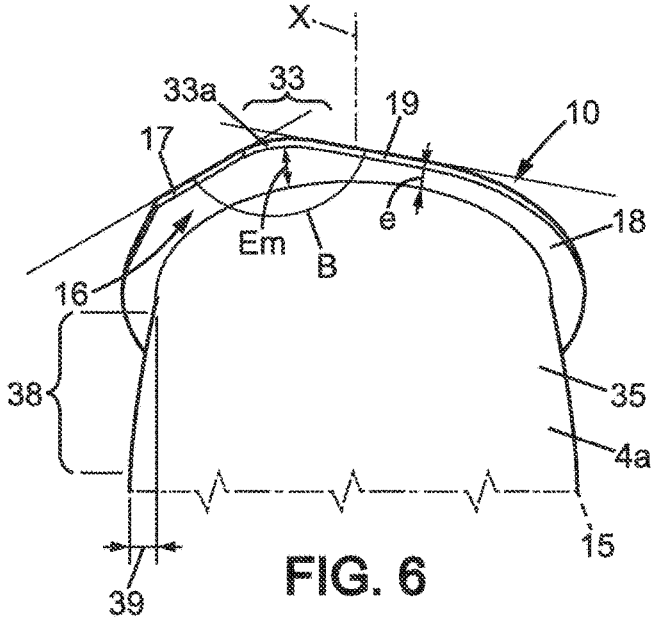
FIG. 6 is a partial view of a container body used in the pack of FIG. 5, before sleeving.

Referring to FIG. 6, it can be seen that the increase in size of the cross sections of the upper portion 4*a* is higher in an annular area 38 at a range of longitudinal distance of about 5-25 mm from the flange 10 as compared to the increase in size of the cross sections of the upper portion 4*a* near the junction 15. This annular area 38 is here intermediate for the upper portion 4*a*. Such geometry, with a tangential connection or large radius of curvature at the connection profile defined at the junction 15, can be of interest to prevent cracks in the side wall 4. The radial spacing 39 for the upper portion 4*a* at the junction 15 (radial outer shifting measured perpendicularly to the longitudinal axis X as compared to a virtual cylinder extending longitudinally downwards from the upper opening 12) may be comprised between 1.5 and 9 mm, preferably between 3 and 6 mm.

The plastic sleeve 5 tapers from the lower annular end 51 to the upper annular end 52 and the ratio SP2:SP1 is superior to 1:0.84 and lower than 1:0.98. It can be seen that each of the first perimeter SP1 and second perimeter SP2 are measured parallel to the flange 10 (i.e. in a respective virtual plane perpendicular relative to the longitudinal axis X). With such configuration, a progressive tapering is obtained.

Referring to FIGS. 3, 5 and 9, with such limited increase for the second perimeter SP2, each container 1 may be advantageously produced as a unit of a food pack 24. The containers 1 are arranged in at least one row, and separably joined to each other at a breakable junction J between two flanges 10 of two distinct containers 1 adjacent in the pack 24. As illustrated in FIG. 5, the constant thickness E10 of the flanges 10 is also provided at the breakable junction J.

Figure 7:
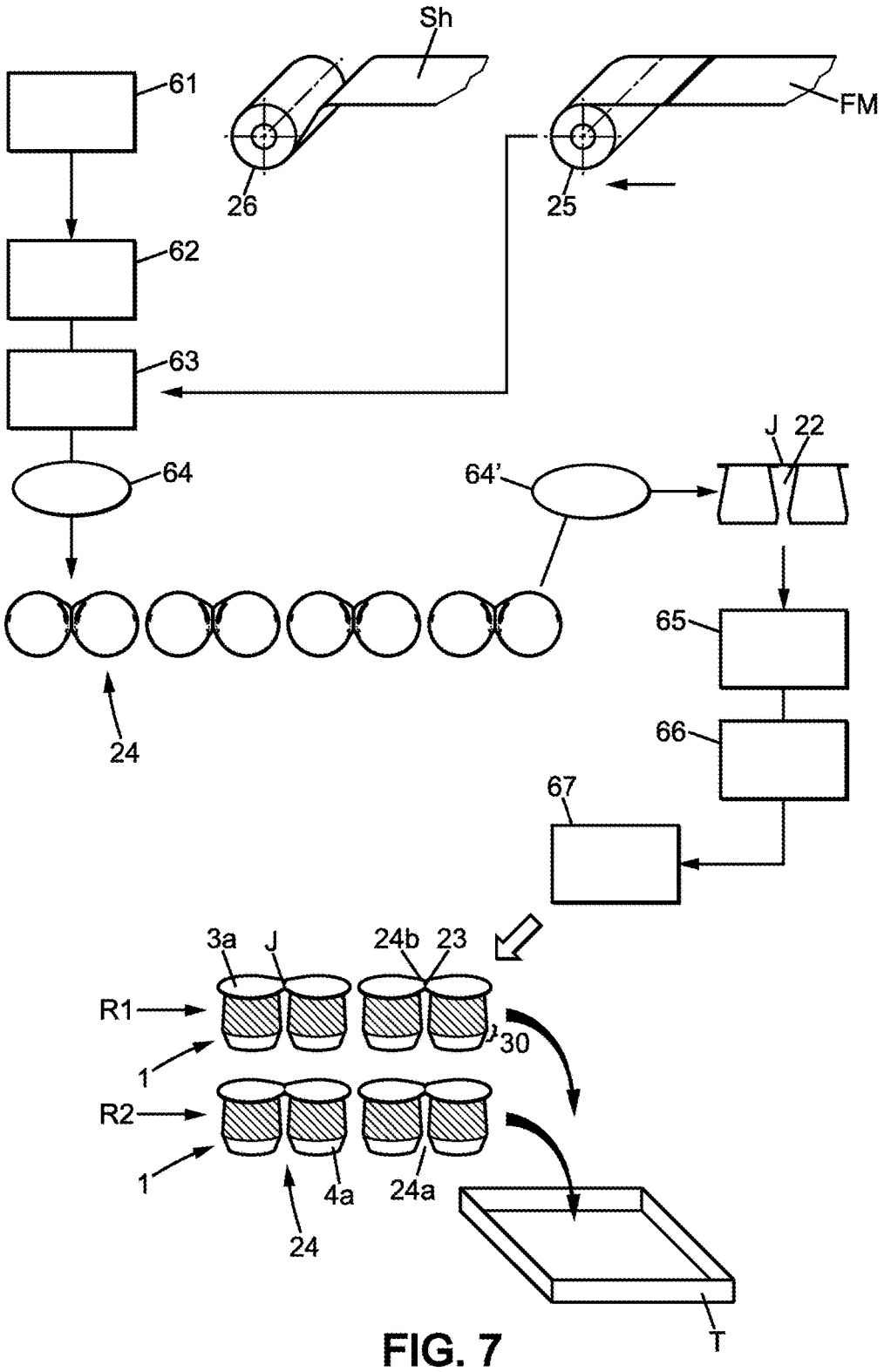
FIG. 7 schematically illustrates some steps of a method of producing containers according to a preferred embodiment of the invention.

Now referring to FIGS. 5, 7 and 9, the pack 24 has a front side 24*a* and a rear side 24*b* and the breakable junction J can be optionally offset toward one of the front side 24*a* and the rear side 24*b*. In the pack 24 shown in FIG. 5, a sharp angle C inferior to 90°, preferably inferior to 70°, is defined by a V-cut 24*c* adjacent to an end 23 of the breakable junction J. In order to have the breakable junction J offset toward the rear side 24*d*, the specific V-cut 24*c* is provided at the front side 24*a*.

The flange 10 can have a maximal radial extension Em specifically provided adjacent to the breakable junction J. For instance the flange 10 does not radially extend from the top 4*c* more than 4 or 5 mm (this is a reduced extension, preferably in one or more convex flange portions 18 that can be continuously rounded), except in one or more protruding portion 16, 16' used to defined the breakable junction J.

Referring to FIGS. 2-6, the maximal radial extension Em is least twice a maximal radial extension e in the convex flange portion 18 of the flange 10. The shape of the outer edge 20 in the convex flange portion 18 is the same as the shape of the inner edge so that e may be a constant radial extension for the convex flange portion 18.

Figure 2:
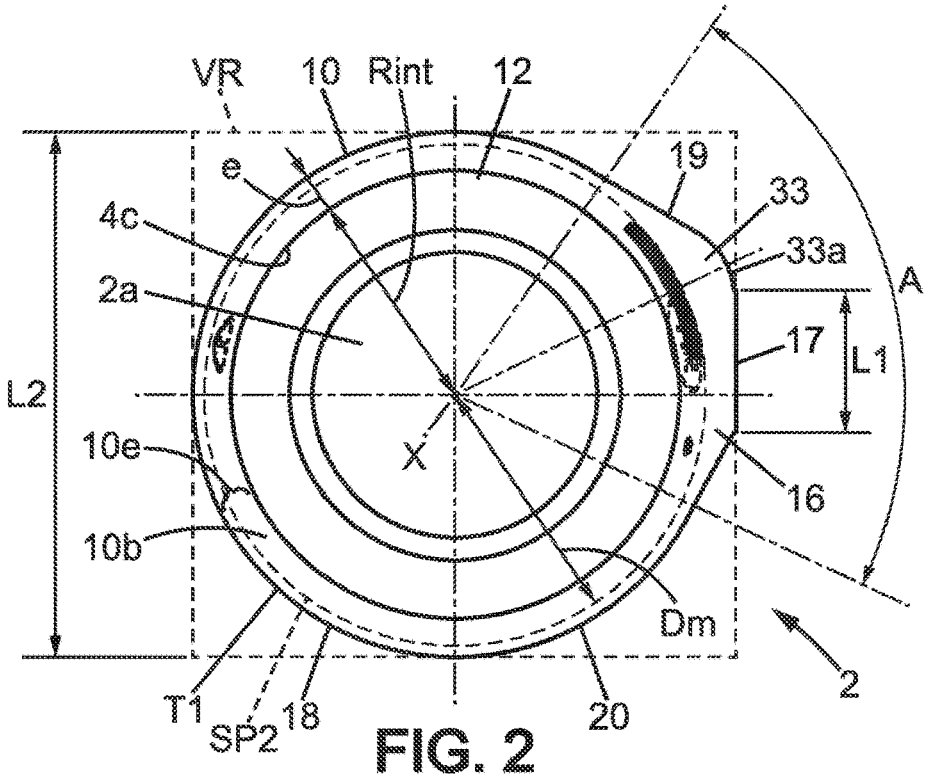
FIG. 2 is a top view of a container similar to the container of FIG. 1.

The maximal radial extension Em is here defined in the protruding portion 16, 16'. An intermediate portion 33 of the protruding portion 16, 16' is provided with a convex rounded outer edge 33*a*, as illustrated in FIG. 2. Such arrangement with a radius of curvature prevents significant sharp edges in an area handled by the final consumer.

Referring to FIG. 4, it can be seen that two protruding portions 16 and 16', which are optionally of identical shape and size, are provided at opposite sides of the flange 10. Of course, such configuration with one or more protruding portions 16, 16' may be used to form a pack of more than two containers 1. While FIG. 9 shows a pack of three containers 1 arranged in one row R1 and having a square-shaped flange 10 (here with a circular opening 12), it is understood that such kind of pack 24 can be obtained using a flange 10 with less plastic material as in FIGS. 4 and 5 for instance. Additionally, packs having more than one row R1 may be obtained. For this purpose, maximal radial extension Em may be increased and/or suitable configuration of mold cavities may be used (for instance mold having four cavities, provided with four movable corner parts). The maximal radial extension Em of the flange 10 can be higher than 7 mm and lower than 16 mm, preferably inferior or equal to 12 mm to limit amount of plastic material in the flange 10.

Now referring to FIGS. 2-6, one or more protruding portions 16, 16' are provided with a determined outer straight side edge 17, 17'. The maximal radial extension Em of the flange 10 is here defined in the intermediate portion 33 and the convex rounded outer edge 33*a* connects the corresponding outer straight side edge 17 to an adjacent outer straight side edge 19. As apparent in FIG. 6, an angle B superior to 100°, and preferably comprised between 110° and 135°, is defined between the determined outer straight side edge 17 and the adjacent outer straight side edge 19. As a result, the radius of curvature is not too small and there is no sharp angle in this area.

The length L1 of this the determined outer straight side edge 17, 17' is here superior to 12 mm and inferior to 30 mm. It thus can define a breakable junction J of reduced size when the containers 1 are part of a pack 24. Each flange 10, which here preferably extends around an upper opening 12 of circular shape, is inscribed in a virtual rectangle VR. As illustrated in FIG. 2, the determined outer straight edge 17 is in alignment with one side of the virtual rectangle VR having a length L2. The following relation is satisfied:

$$1/5<L1/L2<2/5.$$

Such cut around the protruding portion 16 may prevent formation of sharp edges, while offering a sufficient surface for a gripping action by a user. This is especially useful for peeling a sealing membrane 3*a* of the container 1 filled with the food composition 11.

Referring to FIGS. 1-2 and 5, the sealing system 3 is here a single layer sealing system, only comprising a sealing membrane 3*a* that is fixed to an upper face 10*b* of the flange 10, in order to seal the upper opening 12. An appropriate cut is performed to define an outer shape of the sealing membrane 3*a*, optionally simultaneously with respect to the cut of the flange 10. The sealing membrane 3*a* may be a one-piece foil of a film material suitable for food contact. The film material of the sealing membrane 3*a* may be a bendable sheet plastic or a pliable sheet comprising a composite material and/or aluminium. Preferably, the film material has low water permeability, is approved for food contact and is not flammable.

It can be seen in FIG. 5 that a closing portion 31 of the sealing membrane 3*a* is secured to an annular area 10*e* extending around the upper opening 12 and defined by the upper face 10*b*. The closing portion 31 is sealing the upper opening 12. The perimeter of the sealing membrane 3*a* may be greater than the circumference, here a circular circumference, of the annular area 10*e* because of at least one tab portion 32 that protrudes radially outwards. The closing portion 31 and the tab portion 32 may be parts of a single piece foil that defines the sealing membrane 3*a*. The tab portion 32 is entirely offset relative to the annular area 10*e* and can cover the protruding portion 16 without being sealed on the protruding portion 16.

The foil may be obtained using a flexible multilayer sheet with a top face made of plastic so that this upper face may be marked with information, for instance by ink printing. This is advantageous for individualizing the container 1 (for instance when printing a conventional bar-code or a coded 2D-pictogramm or information and/or pictures onto the upper face of the closing portion 31).

When the flange 10 is provided with more than one protruding portion 16, 16', an additional tab portion (not shown) may optionally be added. Referring to FIG. 2, the protruding portion 16 provided with the outer straight edge 17 may extend within the limits of a given angular sector with respect to the longitudinal axis X, this angular sector corresponding to an angle A comprised between 50 and 90°. When a tab portion 32 is provided with the same outer shape and size as the protruding portion 16 as shown in FIG. 5, this tab portion 32 is also comprised within the limits of such angular sector (with angle A not superior to 90°). Such angle A is here measured in a plane (plane defined by the flange 10) perpendicular to the longitudinal axis X.

Referring to FIGS. 2 and 5, the upper opening 12 is wide and well adapted for retrieval of food content, typically a dairy product having a firm texture or a semi-liquid consistency, by a spoon or similar utensil. The term "wide" means that the minimum size of the opening 12 cannot be below 40 mm. Such upper opening 12 is thus wide as compared to the size of the bottom 2*a* and may be provided with a diameter Dint that is superior to 40 mm, preferably superior or equal to 45 mm. Additionally, it is also understood that the container 1 is cup-shaped and thus the side wall 4 has such a shape that a ratio D3/H (width/height) is typically comprised between 0.7:1 and 1:1.2, where width D3 is the maximal width of the tubular side wall 4, here measured at the junction 15. Of course, the height H of the container 1 is here essentially defined by the height of the side wall 4.

Referring to FIGS. 1 and 3-4, the body 2 is here typically made from a thermoplastic material such as polyethylene terephthalate (PET), polystyrene, polypropylene, polyethylene (non limiting examples). More generally, the container 1 can be made of any suitable thermoplastic material, possibly with at least one additional layer.

The flange 10 is integrally formed with the body 2 and connected to the top 4*c*. When the bottom 2*a* and the upper opening 12 are both of circular shape, the diameter Dint of the upper opening 12 is at least as great as the diameter D2 of the circular outer edge 14 defined by the bottom 2*a*. Here it can be seen that the following relation is satisfied:

$$1<Dint/D2<1.25$$

The size or diameter Dint of the upper opening 12 is less than the maximum outer diameter or radial dimension D3, measured in a transverse plane (here a horizontal plane) at the junction 15 between the lower portion 4*b* and the upper portion 4*a*. As shown in FIG. 3, an outer diameter D1 for the flange 10 can be defined at the convex flange portion 18. The following relation is satisfied with respect to this diameter D1 and the constant inner diameter Dint:

$$Dint<D3<D1<3/2*Dint.$$

Of course, the upper opening 12 is not necessarily circular. Similarly, the junction 15 is not necessarily of circular cross section. More generally, there exists a maximal radial distance Dm between the side wall 4 and the longitudinal axis X. In such case, it is of interest of having a bulge 30 and/or a lower portion 4*b* not protruding radially beyond the protruding portion 16 that is used to define a bearing surface for the tab portion 32 of the peelable sealing membrane 3*a* (such protruding portion 16 being also optionally used to define a breakable junction J in a pack 24). In order to have a bulge 30 not protruding more than the protruding portion 16, the following relation is satisfied:

$$Dm<Em+Rint$$

where Rint is a radial distance between the longitudinal axis X and an inner edge of the flange 10, measured at a same angular position as the maximal radial extension Em. When the upper opening 12 has a circular cross section, of course Rint is half of the constant diameter Dint. Such configuration is of interest to allow containers 1 to be formed in a pack having one or more rows R1, R2.

Additionally or in a variant, the flange 10 may be sized to define an outer perimeter T1 not too different from the outer perimeter SP2 defined at the peripheral line that defines the junction 15. More specifically, the following relation is satisfied in the embodiments shown in FIGS. 1-8:

$$0.8<T1/SP2<1.1$$

Accordingly, the containers 1 may be arranged in a particular compact manner in a pack 24 having one or more rows R1, R2.

Figure 8:
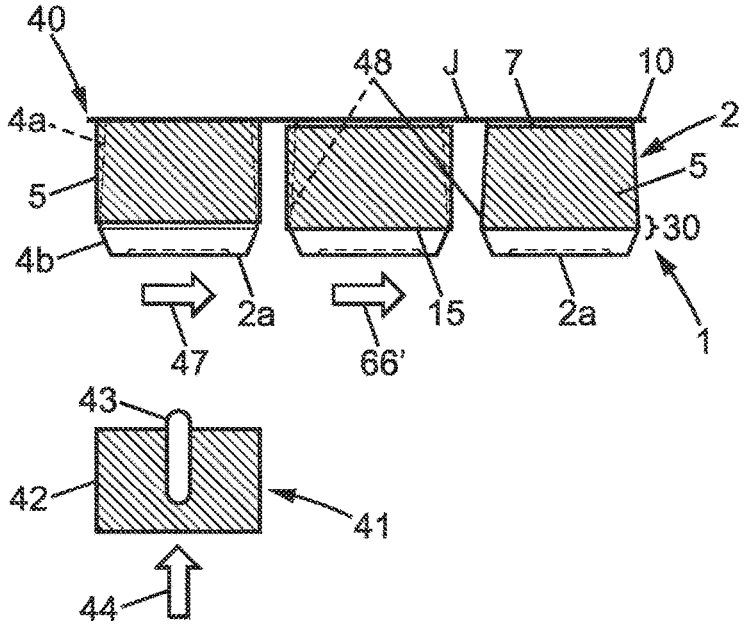
FIG. 8 schematically illustrates some steps for sleeving the containers.

Now referring to FIGS. 5 and 7-8, a non limiting example of making containers 1 is described.

Firstly, a plastic sheet Sh is supplied from the reel 26, such sheet being here not cut after the step 61 of thermoforming the hollow bodies 2, as illustrated in FIG. 7. The material of the sheet Sh is clamped between a mold having one or more forming impressions against a backing mold in which one or more forming dies are displaced, filled and closed. The body 2 is stretched from a plastic sheet Sh (for instance a PET sheet), preferably with a stretching ratio comprised between 2 and 7, preferably between 2.5 and 5. The range 2.5-3.5 may be used for maintaining a high strength in the area or areas not covered by the plastic sleeve 5.

The plastic sheet Sh with the body cavities is filled with the food composition 11 at the step 62. Filing of the interior volume V defined by each cavity is performed through the upper opening 12 with a predetermined dose of the food composition 11.

In the FFS machine or outside the FFS machine (for instance in an auxiliary machine), one additional module is added for performing the steps 63 of sealing the cavity along the upper opening 12 by a sealing membrane 3*a*. As shown in FIG. 7, a membrane film FM is provided from a feeding reel 25 and supplied at step 63. The cutting step 64 to delimit the outer edge of the flexible sealing membrane 3*a* may optionally be performed before the sleeving or, alternatively, after the sleeving. Here, there is no need for any additional closure lid and the top surface of each container 1 is defined by the sealing membrane 3*a*.

At step 61, each cavity of the bodies 2 is formed after heating the plastic sheet Sh. The mold cavities are provided with an increased width with decreasing spacing from a bottom of the mold cavity, except near the bottom of the mold cavity. The side wall 4 of the body 2 is thus already shaped as shown in FIG. 5 (or in variant as in FIG. 9 with an enlarged part that extends as far as the bottom 2*a*). Here, the upper portion 4*a* tapers toward the upper opening 12 and an annular bulge 30 can be defined when the lower portion 4*b* is tapering downwardly. The cavity may be formed in a mold having a plurality of identical mold cavities. Each body 2 is unmold and released from the corresponding mold cavity by moving a part of the mold that partly surrounds this corresponding mold cavity.

It can be seen that the interspace 22 between two adjacent containers 1 is sufficient to allow use of adjacent mold cavities. The minimum distance D6 (FIG. 5) between the bulges 30 in a same pack 24 is here inferior to the distance D8 between the bottom 2*a* and the spacing distance D7 between two adjacent upper openings 12 can be intermediate between the distance D6 and the distance D8. In order to optimize the amount of plastic used in the flange 10, the length L1 of the outer straight side edge 17 may be inferior to the spacing distance D7, while remaining inferior to the distance D6 (in order to optimize the dose to be filled in the body cavities).

While the lower edge 6 shown in FIG. 1 has here a position exactly corresponding or adjacent to the annular area where the minimum distance D6 is obtained, it is understood that a lower part of the upper portion 4*a* can be not covered by the sleeve 5. In such variant (not shown), the lower edge 6 may entirely extend at a same distance from the junction 15. This distance is between 2 and 12 mm for instance. Preferably in such case when a lower portion 4*b* is provided (and especially when the lower portion 4*b* is tapering as in FIGS. 1 and 5), the optional uncovered lower part of the upper portion 4*a* may have a minimum diameter or similar minimum size not inferior to D2.

Here after the cutting step 64 by conventional blade-type cutting devices or the like, packs 24 are formed with one row R1 or optionally several rows R1, R2. An additional step 64' may be used to perform a complementary cut when the number of containers 1 of a pack 24 to be sleeved is different from the number of the containers of the packs obtained after the cutting step 64. For instance, when the sleeving is performed for a pair of containers 1 defining a small pack 24, such additional step 64' may be performed. After cutting of the plastic sheet Sh, the generally planar annular flange 10 is defined, here with a maximal radial extension Em superior or equal to 5 mm.

Referring to FIGS. 7 and 8, the step of sleeving here comprises:

a step 65 of supplying a sleeve 5 of heat shrinkable film near the lower portion 4*b* and arranging the sleeve 5 around the side wall 4 and entirely below the flange 10;

a step 66 of annularly securing the sleeve 5 at least to the upper portion 4*a*, by heating the heat shrinkable film so that the sleeve 5 is securely in contact with the upper portion 4*a*, in particular at least in an annular area adjacent to the junction 15.

A shrink film of about 60 μm thickness or less may be used to define the respective sleeves 5. More generally, a thickness between 25 and 100 μm is preferred. As illustrated in FIG. 8, a mandrel unit 41 that comprises a stationary mandrel 42 is arranged below packs 24 of containers 1. A tubular foil is caused to move upwardly along the mandrel 42 and is cut by cutting means (not shown) to provide a sleeve 5 of suitable dimensions and made of a heat-sensitive shrink film. The mandrel unit 41 further comprises a number of ejectors 43 (for instance rotating wheels) for accelerating the sleeve 5 and shooting 44 the same sleeve 5 upwardly causing the sleeve 5 to be ejected from the mandrel unit 41. A sleeve 5 released from the mandrel 42 and ejected from the mandrel unit 41 travels against the gravitational force in the direction of a container 1 suspended above the mandrel unit 41 from a conventional conveyor 40 moving the containers 1 in direction 47 and is slid over lower portion 4*b* (which is here tapered) of the container 1.

Two rotatable wheels are optionally provided for physically engaging the cut sleeve, accelerating the sleeve and ejecting the sleeve 5 from the mandrel 42 over the container 1. A suitable controller is arranged to operate the units and to synchronize the ejecting with the movement of the containers 1. More specifically, a suitable controller can be configured to synchronise the ejection, container supply, cutting and other method steps.

When a partial sleeve 5 is formed with height h5 lower than height h2, the ejected sleeve 5 can abut against the flange 10 and then can be maintained by use of suitable sleeve bearing devices (not shown). Such sleeve bearing devices are adjacent the lower portion 4*b* and can extend along the junction 15 to bear and maintain the lower edge 6 of the sleeve 5 at a predetermined level. A sleeve bearing device can be a passive plate, extending parallel to the flange 10, and arranged to bear the sleeve 5 at a substantially same level during initial movement of the sleeved container 1 that is going to be heated. When the sleeved container 1 is heated, preferably using steam at a heat shrinking step 66', the sleeve 5 is attached and the upper edge 7 extends parallel to the flange 10. A heated steam oven (not shown) may optionally be provided, in order to heat shrink the cut sleeves that have just been arranged over the containers 1. The steam will heat shrink the sleeve 5 and this sleeve 5 is attached to the side wall 4 above and optionally over the bulge 30. A labelled container is thus obtained. In a subsequent step a drying process can be applied.

Not only the sleeves 5 can be provided at high speed, but also the heat shrinking in the oven is executed quickly, limiting the actual heating of the container 1 that can already contain the food composition 11 such as a dairy product.

It is understood that the plastic sleeve 5 includes a shrink film, preferably a single film, annularly secured to the upper portion 4*a*, so that the plastic sleeve 5 is in contact with this upper portion 4*a* at least in an annular area adjacent to the junction 15. Because of the tapering of the upper portion 4*a*, there is more place for printing characters in an intermediate area of the container side wall 4 (at a distance from the flange 10) and the sleeve 5 cannot easily (unintentionally) be displaced downwardly by a gripping action of a final user, even when the height h5 is relatively small (for instance lower than 50 or 60 mm).

One ore more modules are added for performing the step of sleeving. Each module may have at least two adjacent mandrel unit 41 or a single mandrel unit 41. Optionally, packs 24 of containers 1 can be delivered by such modules arranged at two opposite sides of a conveyor that defines a track and drives the packs 24 in a determined direction of the track toward a tray T, while the packs 24 delivered by the modules are displaced transversely toward the track. A step 67 of grouping the packs 24 delivered by the different modules may thus be performed. On the track, the containers 1 are preferably arranged in a plurality of rows R1, R2, either in one-row packs or in multi-row packs. Of course, any kind of conveyor can be used to transport at least two adjacent rows R1, R2 of containers 1.

According to a preferred embodiment, the steps 61-64 of the manufacturing method are carried out by means of a FFS production machine (Form, Fill and Seal). It is advantageous to implement the thermoforming process in machines using the high rate technology FFS to efficiently produce the food packs 24. In some options, no additional wrapping is required and the packs 24 can be displayed on shelves without any additional packaging material.

It can be seen in FIG. 7 a top view of a food pack 24, here of two containers 1, which can be produced after a step of sleeving (65, 66), or optionally after a step 67 of grouping several packs 24 in an conveyor. As shown in FIG. 7, when arranged in a tray T, each pack 24 of the containers 1 is arranged inside the interior volume defined by the tray T. It can be seen that the containers 1 of a food pack 24 are separably joined to each other at a junction J of two flanges 10 of two distinct containers 1 of the pack 24.

The containers 1 are intended to be filled with a food composition, preferably a dairy composition, for example any liquid or semi-liquid dairy product or similar food, preferably a yoghurt composition. The container 1 can be for example a container of 50 ml (or 50 g), to 1 L (or 1 kg), for example a container of 50 ml (or 50 g) to 80 ml (or 80 g), or 80 ml (or 80 g) to 100 ml (or 100 g), or 100 ml (or 100 g) to 125 ml (or 125 g), or 125 ml (or 125 g) to 150 ml (or 150 g), or 150 ml (or 150 g) to 200 ml (or 200 g), or 200 ml (or 200 g) to 250 ml (or 250 g) or 250 ml (or 250 g) to 300 ml (or 300 g), or 300 ml (or 300 g) to 500 ml (or 500 g), or 500 ml (or 500 g) to 750 ml (or 750 g), or 750 ml (or 750 g) to 1 L (or 1 kg).

The present invention has been described in connection with the preferred embodiments. These embodiments, however, are merely for example and the invention is not restricted thereto. For instance, the circular shape of the upper opening 12 and the configuration of the flange 10 with one or two protruding portions 16, 16' are only given as examples. Other similar shapes can also be particularly user-friendly while the arrangement of the body 2 remains very compact when containing a food composition 11.

It will be understood by those skilled in the art that other variations and modifications can easily be made within the scope of the invention as defined by the appended claims, thus it is only intended that the present invention be limited by the following claims.

For instance, the flanges 10 used for the containers shown in FIGS. 2 and 5-6 can be used in the containers 2 shown in FIGS. 4 and 9 (respectively) and vice versa. Besides, the flange 10 may be circular at least in options with a straight breakable junction J. When no protruding portion is provided, it is understood that the radial extension (Em=e) is a constant. It will be understood by those skilled in the art that other variations and modifications can easily be made within the scope of the invention as defined by the appended claims, thus it is only intended that the present invention be limited by the following claims.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A container for a food composition, in particular a dairy product composition, comprising:

a body comprising a bottom and a side wall extending along a longitudinal axis from the bottom to a top that defines an upper opening, the body being a hollow plastic body, a planar annular flange integral with the body and connected to the top of the body, the flange extending around the upper opening and having a maximal radial extension superior or equal to 3 mm, and a decorative layer extending around the side wall, the side wall comprising an upper portion having a height h2, that comprises the top of the body, wherein the upper portion tapers upwardly toward the upper opening to cause a reduction of cross section at the top of the body, and wherein the decorative layer is defined by a plastic sleeve that includes a shrink film annularly secured to the upper portion, the plastic sleeve being in contact with the upper portion at least in an annular area where there are cross sections of an increasing size with increased spacing from the flange.

2. The container according to claim 1, wherein the side wall comprises a lower portion having a height h1, and wherein either the side wall comprises a peripheral bulge at a junction between the upper portion and the lower portion, or the lower portion has a cylindrical shape, said annular area extending adjacent to the junction.

3. The container of claim 1, wherein the upper opening is circular and the bottom has a circular outer edge.

4. The container of claim 3, wherein the circular outer edge of the bottom defines a diameter D2, the following relation being satisfied:

$$0.75*D2 \leq Dint \leq 1.25*D2$$

where Dint is a diameter of the upper opening.

5. The container of claim 1, wherein the plastic sleeve comprises an upper annular end defining a first perimeter SP1 and a lower annular end defining a second perimeter SP2, the plastic sleeve tapering from the lower annular end to the upper annular end, wherein the ratio SP2:SP1 is superior to 1:0.84 and lower than 1:0.98.

6. The container of claim 2, wherein the plastic sleeve is a single piece having an upper edge adjacent to the flange and a lower edge extending around at least one of the lower portion and the peripheral bulge, and wherein both height h2 of the upper portion and a minimum height h5 of the plastic sleeve, which is defined between the upper edge and the lower edge, are greater than the height h1 of the lower portion.

7. The container of claim 2, wherein the plastic sleeve has a height h5 and is a partial sleeve for the side wall, so that:

at least one part of the lower portion is not covered by the plastic sleeve, the ratio h2:h5 being between 1.3:1 and 1:0.7, or a lower part of the upper portion is not covered by the plastic sleeve, the ratio h2:h5 being between 1.3:1 and 1:0.7.

8. The container of claim 6, wherein the peripheral bulge is a single annular bulge of the side wall and has a circular cross section, and wherein the upper portion has a maximal width D3, defined at the peripheral bulge, which is greater than the height h2, the upper opening having a diameter Dint that is superior to 40 mm.

9. The container of claim 2, wherein the body and the flange are made of a same thermoformed plastic, and wherein the upper portion of the side wall has cross sections of an increasing size with increased spacing from the flange.

10. The container of claim 9, wherein the height h2 of the upper portion is higher than 30 mm and lower than 65 mm, the increase in size of the cross sections of the upper portion being higher at a range of longitudinal distance [5-25 mm] from the flange as compared to the increase in size of the cross sections of the upper portion near the lower portion.

11. The container of claim 2, wherein the maximal radial extension of the flange is higher than 5 mm, and lower than 16 mm, and the flange comprises:

a protruding portion provided with a determined outer straight side edge; and at least one convex flange portion connected to said protruding portion;

wherein the protruding portion radially protrudes outward more, with respect to the side wall, than the convex flange portion, whereby the protruding portion defines said maximal radial extension.

12. The container of claim 11, wherein the following relation is satisfied:

$$Dm < Em + Rint$$

where

Em is the maximal radial extension of the flange,

Dm is a maximal radial distance between the side wall and the longitudinal axis, and Rint is a radial distance between the longitudinal axis and an inner edge of the flange, measured at a same angular position as the maximal radial extension of the flange.

13. The container of claim 11, wherein the convex flange portion has a C-shaped outer edge that is continuously rounded.

14. The container of claim 13, wherein the convex flange portion is a single continuous portion having two ends each connected to the protruding portion, the maximal radial extension of the flange being at least twice a maximal radial extension in the convex flange portion.

15. The container of claim 11, wherein the side wall has an outer diameter or maximum radial dimension D3 at the junction between the lower portion and the upper portion, the flange having a constant outer diameter D1 at said convex flange portion and a constant inner diameter Dint for delimiting the upper opening, and wherein the following relation is satisfied:

$$Dint<D3<D1<1.25*Dint.$$

16. The container of claim 11, comprising a sealing membrane that is fixed only to an upper face of the flange, the sealing membrane sealing the upper opening and defining an uncovered top surface of the container.

17. The container of claim 1, wherein the side wall is provided with a lower portion, the upper portion and the lower portion intersecting and interconnecting at a peripheral intersection line defining a junction, the outer perimeter SP2 defined at the peripheral line and the outer perimeter T1 defined by the flange are such that the following relation is satisfied:

$$0.8<T1/SP2<1.1.$$

18. The container of claim 1, wherein the body is at least partly transparent or translucent and is made of a thermoplastic material.

19. A food pack comprising at least two containers for a food composition, wherein said containers are arranged in at least one row, and separably joined to each other at a breakable junction between two flanges of two distinct containers of the pack, wherein each of said containers comprises:

a body comprising a bottom and a side wall extending along a longitudinal axis from the bottom to a top that defines an upper opening, the body being a hollow plastic body, a planar annular flange integral with the body and connected to the top of the body, the flange extending around the upper opening and having a maximal radial extension superior or equal to 3 mm, and a decorative layer extending around the side wall, the side wall comprising an upper portion that comprises the top of the body, the upper portion tapering upwardly toward the upper opening, the decorative layer being defined by a plastic sleeve that includes a shrink film annularly secured to the upper portion, the plastic sleeve being in contact with the upper portion at least in an annular area.

20. The food pack of claim 19, wherein the flanges have a constant thickness, which is also provided at the breakable junction, and wherein the pack has a front side and a rear side, the breakable junction being offset toward one of the front side and the rear side, a sharp angle inferior to 90° being defined by a V-cut adjacent to an end of the breakable junction at the other one of the front side and the rear side.

21. A container for a food composition, in particular a dairy product composition, comprising:

a body comprising a bottom and a side wall extending along a longitudinal axis from the bottom to a top that defines an upper opening, the body being a hollow plastic body;

a planar annular flange integral with the body and connected to the top of the body, the flange extending around the upper opening and having a maximal radial extension superior or equal to 3 mm, the body and the flange being made of a same thermoformed plastic; and a decorative layer extending around the side wall, the side wall comprising an upper portion having a height h2, that comprises the top of the body, wherein the upper portion tapers upwardly toward the upper opening, wherein the decorative layer is defined by a plastic sleeve that includes a shrink film annularly secured to the upper portion, the plastic sleeve being in contact with the upper portion at least in an annular area, and wherein the upper portion has cross sections of an increasing size with increased spacing from the flange.

* * * * *